US009691328B2

(12) United States Patent
Qing et al.

(10) Patent No.: US 9,691,328 B2
(45) Date of Patent: Jun. 27, 2017

(54) PIXEL DRIVING CIRCUIT, PIXEL DRIVING METHOD AND DISPLAY APPARATUS

(71) Applicants: BOE TECHNOLOGY GROUP CO., LTD., Beijing (CN); Chengdu BOE Optoelectronics Technology Co., Ltd., Chengdu, Sichuan Province (CN)

(72) Inventors: Haigang Qing, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu Sichuan (CN)

( * ) Notice: Subject to any disclaimer, the term of this patent is extended or adjusted under 35 U.S.C. 154(b) by 107 days.

(21) Appl. No.: 14/892,188

(22) PCT Filed: May 27, 2015

(86) PCT No.: PCT/CN2015/079901
§ 371 (c)(1),
(2) Date: Nov. 18, 2015

(87) PCT Pub. No.: WO2016/086626
PCT Pub. Date: Jun. 9, 2016

(65) Prior Publication Data

US 2016/0351126 A1 Dec. 1, 2016

(30) Foreign Application Priority Data

Dec. 5, 2014 (CN) ..... 2014 1 0738074

(51) Int. Cl.
*G09G 5/10* (2006.01)
*G09G 3/3258* (2016.01)
(Continued)

(52) U.S. Cl.
CPC ..... *G09G 3/3258* (2013.01); *G09G 3/3225* (2013.01); *G09G 3/3266* (2013.01);
(Continued)

(58) Field of Classification Search
CPC .. G09G 3/3258; G09G 3/3266; G09G 3/3291; G09G 2300/0426; G09G 2300/043; G09G 2300/0852
See application file for complete search history.

(56) References Cited

U.S. PATENT DOCUMENTS

2013/0113779 A1 5/2013 Yoon et al.
2014/0333214 A1 11/2014 Okuno et al.

FOREIGN PATENT DOCUMENTS

CN 101609840 A 12/2009
CN 102651192 A 8/2012
(Continued)

OTHER PUBLICATIONS

International Search Report and Written Opinion in Chinese, dated Aug. 28, 2015, for corresponding PCT Application No. PCT/CN2015/079901.
(Continued)

*Primary Examiner* — Towfiq Elahi
(74) *Attorney, Agent, or Firm* — Kinney & Lange, P.A.

(57) ABSTRACT

The present disclosure relates to a pixel driving circuit, a pixel driving method and a display apparatus. In addition to a storage unit in a conventional pixel driving circuit, the pixel driving circuit comprises an auxiliary storage unit, which is charged to a data voltage in a charging phase and stables a gate potential of a driving unit when a data voltage write switch is turned off in a threshold voltage compensation phase, so that there is enough time for the storage unit of the driving unit to acquire the data voltage and a threshold voltage of the driving unit through self-discharge and the
(Continued)

storage unit of the driving unit compensates for the driving unit in a driving phase. In this way, operating current of the driving unit is not influenced by the threshold voltage.

20 Claims, 7 Drawing Sheets

(51) Int. Cl.
*G09G 3/3266* (2016.01)
*G09G 3/3291* (2016.01)
*G09G 3/3225* (2016.01)

(52) U.S. Cl.
CPC ..... *G09G 3/3291* (2013.01); *G09G 2300/043* (2013.01); *G09G 2300/0426* (2013.01); *G09G 2300/0819* (2013.01); *G09G 2300/0852* (2013.01); *G09G 2300/0861* (2013.01); *G09G 2300/0876* (2013.01)

(56) References Cited

FOREIGN PATENT DOCUMENTS

| | | | |
|---|---|---|---|
| CN | 102708789 | A | 10/2012 |
| CN | 102982767 | A | 3/2013 |
| CN | 103489393 | A | 1/2014 |
| CN | 103778889 | A | 5/2014 |
| CN | 104409043 | A | 3/2015 |
| KR | 20040067029 | A | 7/2004 |
| KR | 20100072645 | A | 7/2010 |

OTHER PUBLICATIONS

First Chinese Office Action (including English translation) dated Mar. 29, 2016, for corresponding Chinese Application No. 201410738074.5.

English translation of Box V of the Written Opinion dated Aug. 18, 2015, for corresponding PCT Application No. PCT/2015/079901.

PIXEL DRIVING CIRCUIT, PIXEL DRIVING METHOD AND DISPLAY APPARATUS

CROSS-REFERENCE TO RELATED APPLICATION(S)

This application is a Section 371 National Stage Application of International Application No. PCT/CN2015/079901, filed on 27 May 2015, entitled "PIXEL DRIVING CIRCUIT, PIXEL DRIVING METHOD AND DISPLAY APPARATUS", which has not yet published, which claims priority to Chinese Application No. 201410738074.5, filed on 5 Dec. 2014, incorporated herein by reference in their entirety.

TECHNICAL FIELD

The present disclosure relates to the field of display technology, and more particularly, to a pixel driving circuit, a pixel driving method, and a display apparatus.

BACKGROUND

Active Matrix/Organic Light-Emitting Displays (AMOLEDs) are one of hotspots in the research field of flat panel display today. Compared with Liquid Crystal Displays (LCDs), Organic Light-Emitting Diodes (OLEDs) have advantages such as low energy consumption, a low production cost, self-illumination, a wide angle of view, a fast response speed or the like. Currently, in the display field of mobile phones, PDAs, digital cameras or the like, OLEDs have begun to replace conventional LCD screens.

Compared with Thin Film Field Effect Transistor (TFT)-LCDs using a stable voltage to control brightness, OLEDs belong to current drive, and need stable current to control light emitting. As shown in FIG. 1, a conventional AMOLED pixel driving circuit is implemented using a 2T1C pixel driving circuit. The circuit only comprises one Driving Thin Film Transistor (DTFT), one switch Thin Film Transistor (TFT) (i.e., T1) and one storage capacitor C. When a certain row is gated (i.e., scanned) by scanning lines, a scanning signal Vscan is at a low level, T1 is turned on, and a data signal Vdata is written into the storage capacitor C. After the scanning for this row ends, Vscan is converted into a high level signal, T1 is turned off, and the DTFT is driven by a gate voltage stored in the storage capacitor C, to generate current to drive the OLED, so as to ensure that the OLED continuously emits light in one frame of display. A current equation when the driving thin film transistor DTFT reaches saturation is $I_{oled}$=K(Vgs−Vth)^2, wherein K is a parameter related to a process and a design, Vgs is a gate-source voltage for driving the thin film transistor, and Vth is a threshold voltage for driving the thin film transistor. Once the size and process of the transistor are determined, the parameter K is determined. FIG. 2 illustrates a timing diagram of an operation of the pixel driving circuit illustrated in FIG. 1, i.e., illustrating a timing relationship between a scanning signal provided by the scanning lines and a data signal provided by data line.

The AMOLED can emit light since it is driven by current generated by the driving thin film transistor DTFT in a saturation state. No matter a Low Temperature Poly Silicon (LTPS) process or an Oxide process is used, due to non-uniformity of the processes, threshold voltages of the driving thin film transistor DTFT in different positions may differ. Since when the same driving voltage is input, different threshold voltages may cause generation of different driving currents, inconsistency of current flowing through the OLED may occur, which results in non-uniformity of display brightness, thereby influencing the display effect of the whole image.

The existing proposed solutions are to add a compensation unit in each pixel to eliminate the influence of the threshold voltage Vth by compensating for the driving transistor. However, most of the existing AMOLED compensation units require a data write switch to turn on all the time in the threshold voltage compensation phase of the driving transistor, until the driving transistor is turned off automatically. This phase lasts for a long time. For a high-resolution AMOLED panel, data write time for each row of pixels becomes increasingly short. However, for a circuit which requires the data write switch to turn on all the time in the compensation phase, the threshold voltage cannot be acquired in short write time, and thereby the circuit cannot support the high-resolution AMOLED panel.

Therefore, there is a need for a pixel driving circuit and method which can shorten write time of a data voltage while ensuring that there is enough time to compensate for the threshold voltage of the driving unit.

SUMMARY

The present disclosure proposes a pixel driving circuit, a pixel driving method, and a display apparatus.

According to a first aspect of the present disclosure, a pixel driving circuit for driving a light-emitting element is provided, comprising:

a light-emitting control signal line configured to provide a light-emitting control signal;

a driving unit having an input end connected to a first intermediate node, a control end connected to a third intermediate node, and an output end connected to one end of the light-emitting element, wherein the light-emitting element has the other end connected to a first power line;

a first switch unit having an input end connected to a second power line, a control end connected to the light-emitting control signal line, and an output end connected to the first intermediate node;

a second switch unit having an input end connected to a reference signal line, a control end connected to a second level of scanning signal lines, and an output end connected to a second intermediate node;

a first storage unit having a first end connected to the first intermediate node and a second end connected to the second intermediate node;

a second storage unit having a first end connected to the second intermediate node and a second end connected to the third intermediate node;

a third switch unit having an input end connected to the third intermediate node, a control end connected to a third level of scanning signal lines, and an output end connected to the second intermediate node;

a charging control unit having a first input end connected to the reference signal line, a second input end connected to a data line, a control end connected to the first level of scanning signal lines, a first output end connected to the second intermediate node, and a second output end connected to the third intermediate node;

wherein, in a first operation phase of the pixel driving circuit, the second power line and the first intermediate node are conducted by the first switch unit under the control of the light-emitting control signal output by the light-emitting control signal line, the reference signal line and the second intermediate node are conducted by the charging control unit under the control of a first level of scanning signals output by the first level of scanning signal lines, to charge the first storage unit connected to the first intermediate node and the second intermediate node, and the data line and the third intermediate node are conducted by the charging control unit to charge the second storage unit connected to the third intermediate node and the second intermediate node;

in a second operation phase of the pixel driving circuit, the reference signal line and the second intermediate node are conducted by the second switch unit under the control of a second level of scanning signals output by the second level of scanning signal lines, to maintain a voltage across the second storage unit so as to stable a voltage at the control end of the driving unit, while the first switch unit is turned off by the light-emitting control signal, and the first storage unit is self-discharged through the driving unit, to store a data voltage and a threshold voltage of the driving unit in a self-discharge manner;

in a third operation phase of the pixel driving circuit, the third intermediate node and the second intermediate node are conducted by the third switch unit under the control of the third level of scanning signals output by the third level of scanning signal lines, to discharge the second storage unit;

in a driving phase of the pixel driving circuit, the second power line and the first intermediate node are conducted by the first switch unit under the control of the light-emitting control signal output by the light-emitting control signal line, so that a voltage difference between the control end and the input end of the driving unit is equal to a voltage of the first storage unit, to compensate for the threshold voltage of the driving unit, so as to make driving current provided by the driving unit to the light-emitting element be unrelated to the threshold voltage of the driving unit.

In an embodiment of the present disclosure, the driving unit comprises a driving transistor, having a gate connected to the third intermediate node, a first electrode connected to said one end of the light-emitting element, and a second electrode connected to the first intermediate node, wherein the first electrode is one of a source and a drain, and the second electrode is the other of the source and the drain.

In an embodiment of the present disclosure, the first switch unit comprises a first transistor, having a first electrode connected to the second power line, a gate connected to the light-emitting control signal line, and a second electrode connected to the first intermediate node, wherein the first electrode is one of a source and a drain, and the second electrode is the other of the source and the drain.

In an embodiment of the present disclosure, the second switch unit comprises a third transistor, having a first electrode connected to the reference signal line, a gate connected to the second level of scanning signal lines, and a second electrode connected to the second intermediate node, wherein the first electrode is one of a source and a drain, and the second electrode is the other of the source and the drain.

In an embodiment of the present disclosure, the first storage unit comprises a first storage capacitor connected between the first intermediate node and the second intermediate node.

In an embodiment of the present disclosure, the second storage unit comprises a second storage capacitor connected between the second intermediate node and the third intermediate node.

In an embodiment of the present disclosure, the third switch unit comprises a second transistor, having a first electrode connected to the third intermediate node, a gate connected to the third level of scanning signal lines, and a second electrode connected to the second intermediate node, wherein the first electrode is one of a source and a drain, and the second electrode is the other of the source and the drain.

In an embodiment of the present disclosure, the charging control unit comprises a fourth transistor and a fifth transistor, in which each of the fourth transistor and the fifth transistor has a gate connected to the first level of scanning signal lines, the fourth transistor has a first electrode connected to the reference signal line and a second electrode connected to the second intermediate node, and the fifth transistor has a first electrode connected to the data line and a second electrode connected to the third intermediate node, wherein the first electrode is one of a source and a drain, and the second electrode is the other of the source and the drain.

In an embodiment of the present disclosure, the driving transistor, the switch transistor, the first transistor, the second transistor and the third transistor are P-type thin film transistors.

According to a second aspect of the present disclosure, a pixel driving method applied in the pixel driving circuit according to the present disclosure is provided, comprising:

providing a first level of scanning signals through the first level of scanning signal lines, while providing a light-emitting control signal through the light-emitting control signal line and a data signal on the data line, so that the pixel driving circuit enters a first operation phase;

turning off the light-emitting control signal before or when the first level of scanning signals is turned off, so that the pixel driving circuit enters a second operation phase;

providing a second level of scanning signals through the second level of scanning signal lines;

providing a third level of scanning signals through the third level of scanning signal lines, so that the pixel driving circuit enters a third operation phase; and providing the light-emitting control signal through the light-emitting control signal line when the third level of scanning signals is turned off, so that the pixel driving circuit enters a driving phase.

According to a third aspect of the present disclosure, a display apparatus is provided, comprising the pixel driving circuit described above.

BRIEF DESCRIPTION OF THE DRAWINGS

The above and other purposes, features, and advantages of the present disclosure will be more clear by describing preferable embodiments of the present disclosure with reference to accompanying drawings, in which.

DETAILED DESCRIPTION

The exemplary embodiments of the present disclosure will be described in detail below in conjunction with accompanying drawings. In the following description, some specific embodiments are only examples of the present disclosure, which are merely used for the purpose of description, and should not be construed as limiting the present disclosure. General structures or constructions will be omitted so as not to obscure the understanding of the present disclosure.

Figure 1:
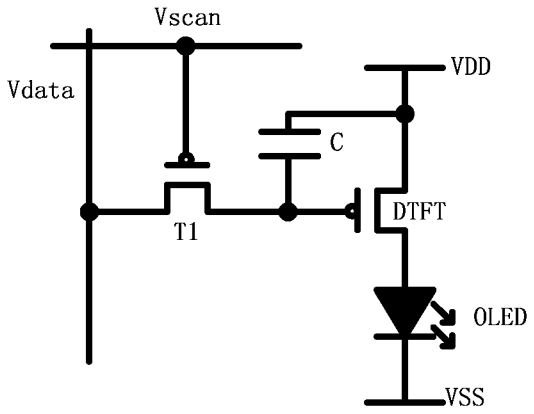
FIG. 1 is a structural diagram of a conventional pixel driving circuit.
Figure 2:
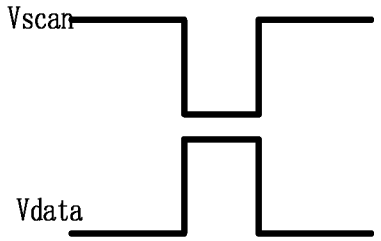
FIG. 2 is a timing diagram of an operation of a conventional pixel driving circuit.
Figure 3:
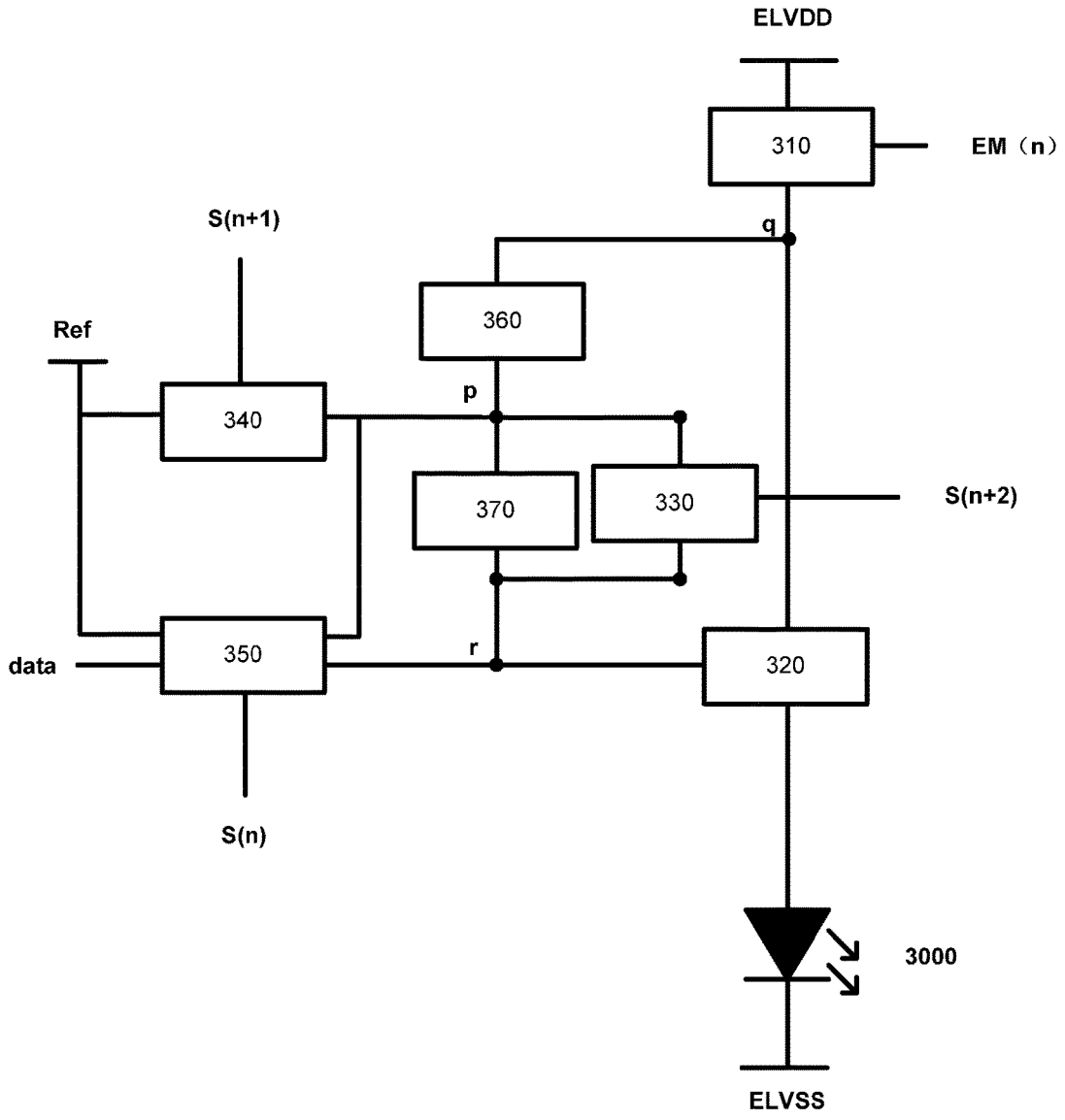
FIG. 3 is a structural diagram of a pixel driving circuit according to an embodiment of the present disclosure.

FIG. 3 is a structural diagram of a pixel driving circuit 300 according to an embodiment of the present disclosure. The pixel driving circuit 300 is used to drive a light-emitting element 3000. In FIG. 3, the light-emitting element 3000 is illustrated as a light-emitting diode OLED. As shown in FIG. 3, the pixel driving circuit 300 according to the embodiment of the present disclosure comprises a light-emitting control signal line EM(n) configured to provide a light-emitting control signal; a first switch unit 310 having an input end connected to a second power line ELVDD, a control end connected to the light-emitting control signal line EM(n), and an output end connected to a first intermediate node q; a driving unit 320 having an input end connected to the first intermediate node q, a control end connected to a third intermediate node r, and an output end connected to one end of the light-emitting element, wherein the light-emitting element has the other end connected to a first power line ELVSS; a third switch unit 330 having an input end connected to the third intermediate node r, a control end connected to a third level of scanning signal lines S(n+2), and an output end connected to a second intermediate node p; a second switch unit 340 having an input end connected to a reference signal line Ref, a control end connected to a second level of scanning signal lines S(n+1), and an output end connected to the second intermediate node p; a charging control unit 350 having a first input end connected to the reference signal line Ref, a second input end connected to a data line data, a control end connected to the first level of scanning signal lines S(n), a first output end connected to the second intermediate node p, and a second output end connected to the third intermediate node r; and a first storage unit 360 having a first end connected to the first intermediate node q and a second end connected to the second intermediate node p; and a second storage unit 370 having a first end connected to the second intermediate node p and a second end connected to the third intermediate node r.

In a first operation phase of the pixel driving circuit 300, the second power line ELVDD and the first intermediate node q are conducted by the first switch unit 310 under the control of the light-emitting control signal Vemb(n) output by the light-emitting control signal line ELVDD. The reference signal line Ref and the second intermediate node p are conducted by the charging control unit 350 under the control of a first level of scanning signals Vs(n) output by the first level of scanning signal lines s(n), to charge the first storage unit 360 connected to the first intermediate node q and the second intermediate node p, so that a voltage of $V=V_{ELVDD}-Vref$ is stored in the first storage unit 360, wherein $V_{ELVDD}$ represents a potential of the second power line ELVDD, and Vref represents a potential of the reference signal line Ref. The data line data and the third intermediate node r are conducted by the charging control unit 350 to charge the second storage unit 370 connected to the third intermediate node r and the second intermediate node p, so that a voltage of V=Vdata−Vref is stored in the second storage unit 370, wherein Vdata represents a data voltage.

In a second operation phase of the pixel driving circuit 300, the reference signal line Ref and the second intermediate node p are conducted by the second switch unit 340 under the control of a second level of scanning signals Vs(n+1) output by the second level of scanning signal lines s(n+1), to maintain the voltage on the second storage unit 370. As the charging control unit 350 is turned off by the first level of scanning signals in this phase, a data voltage at the control end of the driving unit 320 may be well stabilized by the second storage unit 370. At the same time, as the first switch unit 310 is turned off by the light-emitting control signal, the first storage unit 360 is self-discharged through the driving unit 320, to store a charging voltage related to the data voltage and a threshold voltage of the driving unit, i.e., V1=Vdata+|Vthd|−Vref, wherein Vthd represents the threshold voltage of the driving unit 320.

In a third operation phase of the pixel driving circuit 300, the third intermediate node r and the second intermediate node p are conducted by the third switch unit 330 under the control of the third level of scanning signals Vs(n+2) output by the third level of scanning signal lines S(n+2), to discharge the second storage unit 370, i.e., a voltage difference between both ends of the second storage unit 370 becomes 0.

In a fourth operation phase of the pixel driving circuit 300, i.e., a driving phase, the second power line ELVDD and the first intermediate node q are conducted by the first switch unit 310 under the control of the light-emitting control signal Vemb(n) output by the light-emitting control signal line EM(n), so that a voltage difference between the control end and the input end of the driving unit 320 is equal to a sum of the voltage stored in the first storage unit and the voltage stored in the second storage unit. As a voltage difference between both ends of the second storage unit is 0, a voltage difference between the control end and the input end of the driving unit 320 is V1=Vdata+|Vthd|−Vref. At this time, the driving current provided by the driving unit 320 to the light-emitting element 3000 is unrelated to the threshold voltage Vthd thereof.

The first level of scanning signal lines, the second level of scanning signal lines, and the third level of scanning signal lines are connected to an output end of an $n^{th}$ level of shift registers, and an output end of an $n+1^{th}$ level of shift registers, and an output end of an $n+2^{th}$ level of shift registers respectively.

Figure 4:
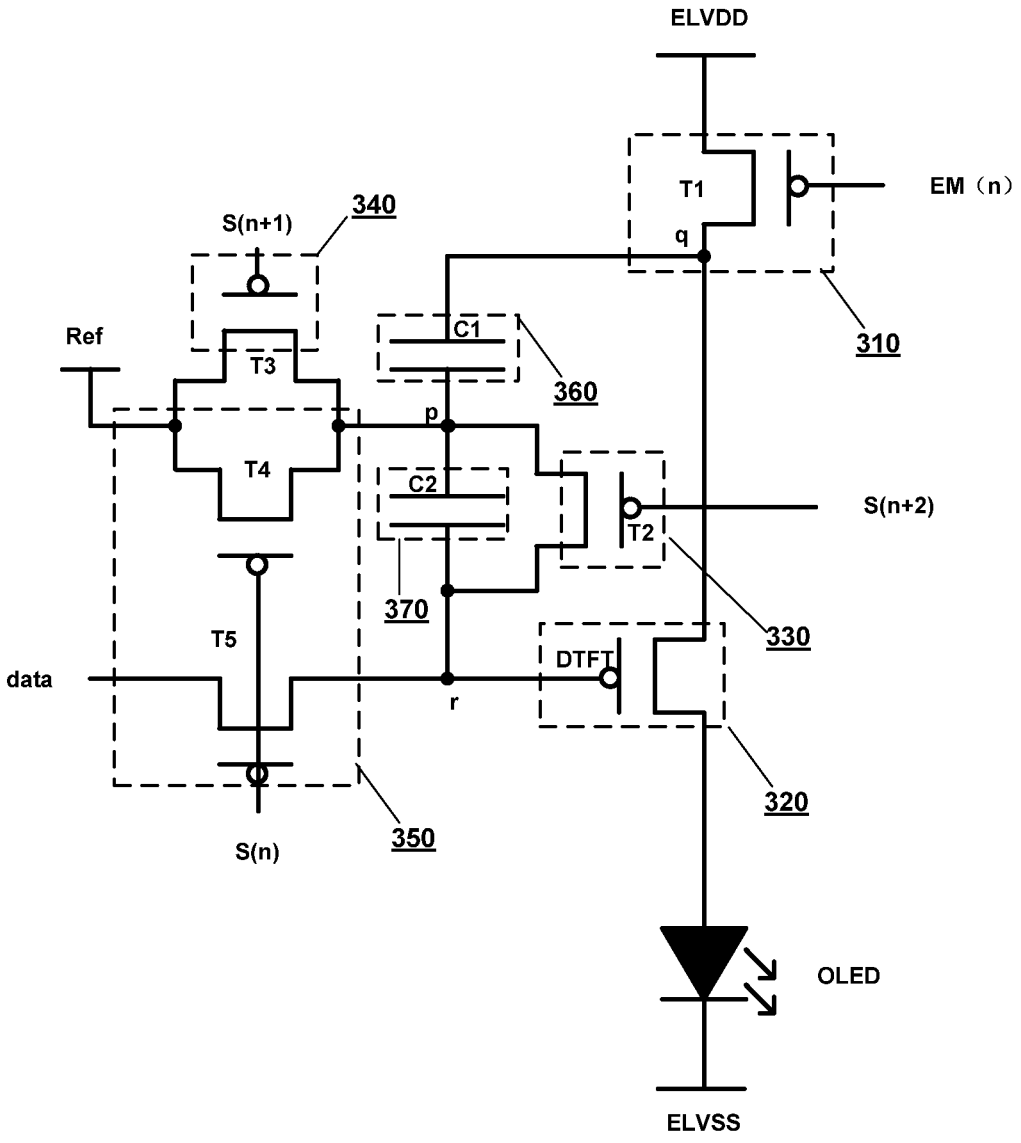
FIG. 4 is a structural diagram of a pixel driving circuit according to another embodiment of the present disclosure.

FIG. 4 is a structural diagram of a pixel driving circuit 400 according to another embodiment of the present disclosure.

As shown in FIG. 4, in the pixel driving circuit 400 according to the embodiment of the present disclosure, the first switch unit 310 comprises a first transistor T1, having a source connected to the second power line ELVDD, a gate connected to the light-emitting control signal line EM(n), and a drain connected to the first intermediate node q. In the embodiment, the first transistor T1 has the source corresponding to the input end of the first switch unit 310, the gate corresponding to the control end of the first switch unit 310, and the drain corresponding to the output end of the first switch unit 310.

As shown in FIG. 4, in the pixel driving circuit 400 according to the embodiment of the present disclosure, the driving unit 320 comprises a driving transistor DTFT, having a source connected to the first intermediate node q, a gate connected to the third intermediate node r, and a drain connected to one end of the light-emitting element OLED. In the embodiment, the driving transistor DFTF has the source corresponding to the input end of the driving unit 310, the gate corresponding to the control end of the driving unit 310, and the drain corresponding to the output end of the driving unit 310.

As shown in FIG. 4, in the pixel driving circuit 400 according to the embodiment of the present disclosure, the third switch unit 330 comprises a second transistor T2, having a drain connected to the third intermediate node r, a gate connected to the third level of scanning signal lines S(n+2), and a source connected to the second intermediate node p. In the embodiment, the second transistor T2 has the drain corresponding to the input end of the third switch unit 330, the gate corresponding to the control end of the third switch unit 330, and the source corresponding to the output end of the third switch unit 330.

As shown in FIG. 4, in the pixel driving circuit 400 according to the embodiment of the present disclosure, the second switch unit 340 comprises a third transistor T3, having a source connected to the reference signal line Ref, a gate connected to the second level of scanning signal lines S(n+1), and a drain connected to the second intermediate node p. In the embodiment, the third transistor T3 has the source corresponding to the input end of the second switch unit 340, the gate corresponding to the control end of the second switch unit 340, and the drain corresponding to the output end of the second switch unit 340.

As shown in FIG. 4, in the pixel driving circuit 400 according to the embodiment of the present disclosure, the charging control unit 350 comprises a fourth transistor T4 and a fifth transistor T5, in which each of the fourth transistor T4 and the fifth transistor T5 has a gate connected to the first level of scanning signal lines S(n), the fourth transistor T4 has a source connected to the reference signal line Ref and a drain connected to the second intermediate node p, and the fifth transistor T5 has a source connected to the data line data and a drain connected to the third intermediate node r. In the embodiment, each of the fourth transistor T4 and the fifth transistor T5 has the gate corresponding to the control end of the charging control unit 350, the fourth transistor T4 has the source corresponding to the first input end of the charging control unit 350 and the drain corresponding to the first output end of the charging control unit 350, and the fifth transistor T5 has the source corresponding to the second input end of the charging control unit 350 and the drain corresponding to the second output end of the charging control unit 350.

As shown in FIG. 4, in the pixel driving circuit 400 according to the embodiment of the present disclosure, the first storage unit 360 comprises a first storage capacitor C1 connected between the first intermediate node q and the second intermediate node p.

As shown in FIG. 4, in the pixel driving circuit 400 according to the embodiment of the present disclosure, the second storage unit 370 comprises a second storage capacitor C2 connected between the second intermediate node p and the third intermediate node r.

The driving transistor DTFT, the first transistor T1, the second transistor T2, the third transistor T3, the fourth transistor T4, and the fifth transistor T5 illustrated in FIG. 4 may be P-type thin film transistors. According to the type of the transistors which are used, the source and the drain of each of the driving transistor DTFT, the first transistor T1, the second transistor T2, the third transistor T3, the fourth transistor T4, and the fifth transistor T5 may be interchanged.

The transistors may be enhancement transistors made in the LTPS process, or may also be depletion transistors made in the Oxide process. Of course, various transistors according to the embodiment of the present disclosure may also be other types of transistors.

Figure 5:
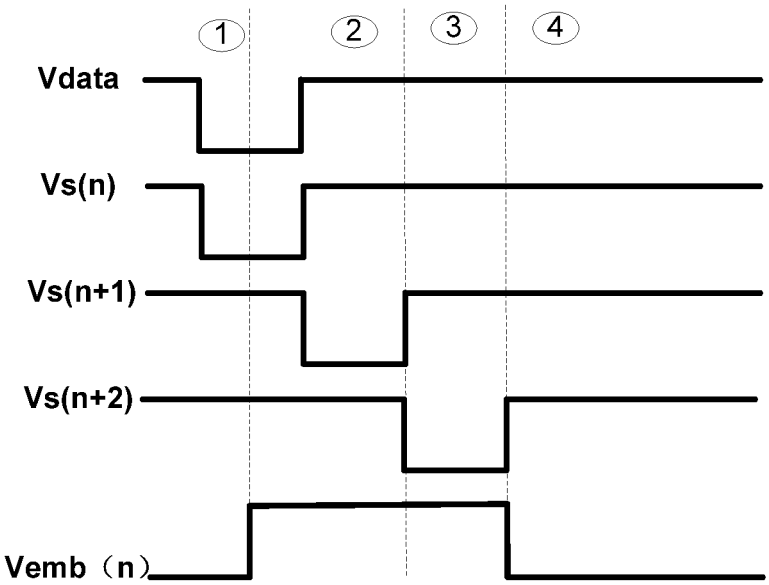
FIG. 5 is a structural diagram of a pixel driving circuit according to another embodiment of the present disclosure.

FIG. 5 is a timing diagram of an operation of a pixel driving circuit 400 according to an embodiment of the present disclosure. As shown in FIG. 5, the pixel driving circuit 400 has four phases, i.e., a first operation phase, a second operation phase, a third operation phase, and a fourth operation phase, which is a driving phase.

Figure 6:
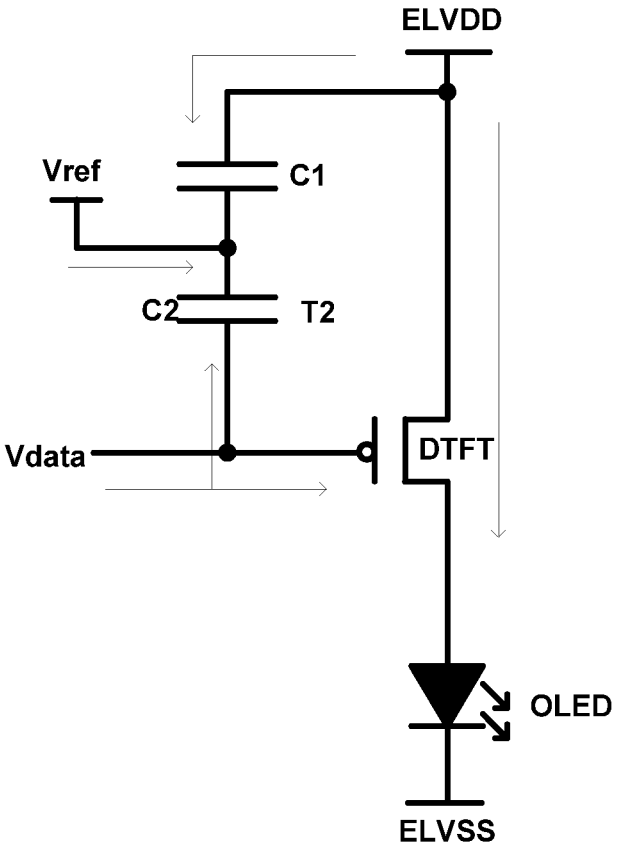
FIG. 6 is an equivalent circuit diagram of a pixel driving circuit according to another embodiment of the present disclosure in a first operation phase.
Figure 7:
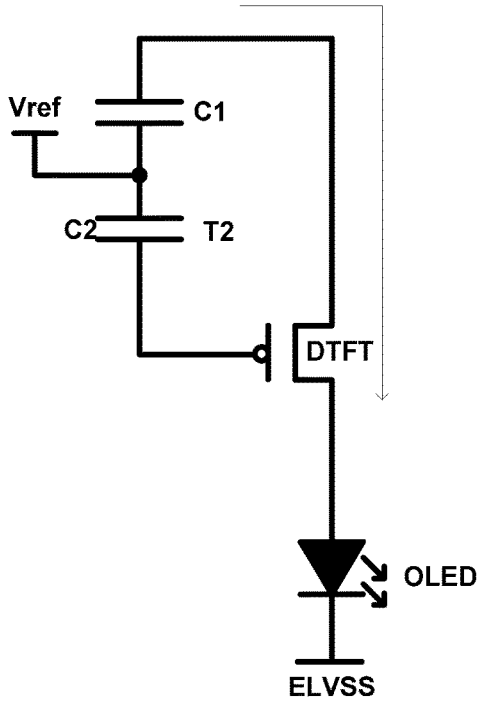
FIG. 7 is an equivalent circuit diagram of a pixel driving circuit according to another embodiment of the present disclosure in a second operation phase.
Figure 8:
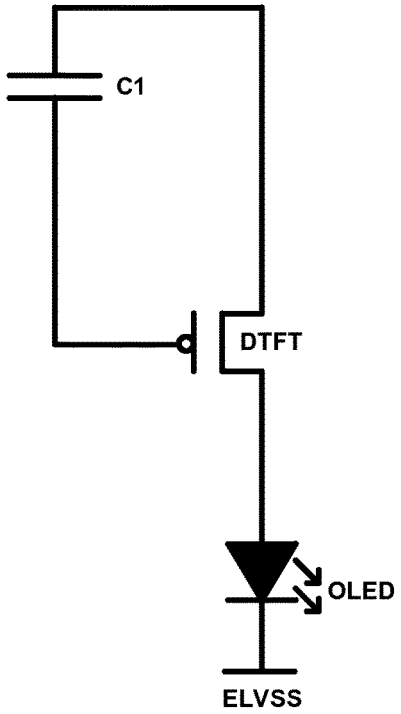
FIG. 8 is an equivalent circuit diagram of a pixel driving circuit according to another embodiment of the present disclosure in a third operation phase.
Figure 9:
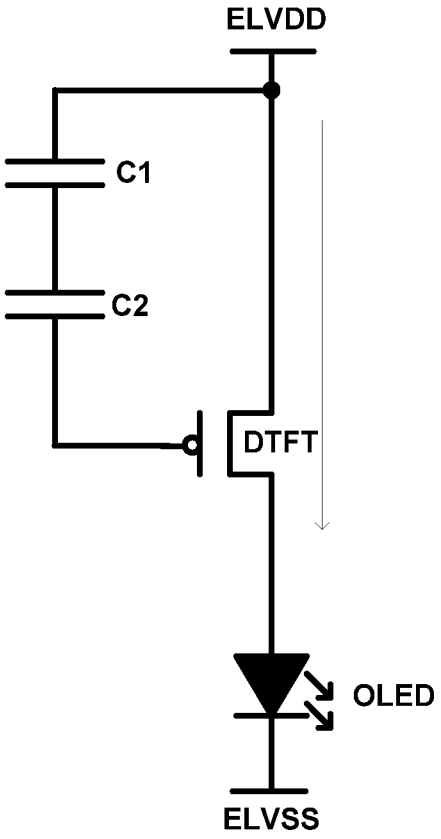
FIG. 9 is an equivalent circuit diagram of a pixel driving circuit according to another embodiment of the present disclosure in a driving phase.

FIG. 6 is an equivalent circuit diagram of a pixel driving circuit 400 according to an embodiment of the present disclosure in a first operation phase. FIG. 7 is an equivalent circuit diagram of a pixel driving circuit 400 according to an embodiment of the present disclosure in a second operation phase. FIG. 8 is an equivalent circuit diagram of a pixel driving circuit 400 according to an embodiment of the present disclosure in a third operation phase. FIG. 9 is an equivalent circuit diagram of a pixel driving circuit 400 according to an embodiment of the present disclosure in a driving phase. The operation flow of the pixel driving circuit 400 according to the embodiment of the present disclosure will described below in conjunction with FIGS. 5-9.

Assume that in the embodiment, various transistors are turned on at a low level, and are turned off at a high level. A high level of a power source is illustrates as ELVDD, and a low level of the power source is illustrated as ELVSS. All transistors are P-type transistors. It can be understood by those skilled in the art that the present disclosure is not limited thereto.

In a first operation phase, a first level of scanning signals Vs(n) provided by the first level of scanning signal lines S(n) is at a low level, the data line provides a data signal Vdata, and a light-emitting control signal Vemb(n) provided by the light-emitting control signal line EM(n) is at a low level. Other control signals, i.e., a second level of scanning signals, and a third level of scanning signals, are at a high level. Therefore, T1, T4 and T5 are turned on, and T2 and T3 are turned off. Whether the driving transistor DTFT is turned on or turned off is related to the data voltage Vdata. In this phase, a reference signal voltage Vref provided by the reference signal line Ref achieves point p through T4, the ELVDD charges C1 through T1, and the Vdata charges C2 through T5. Therefore, when the phase ends, a voltage across C1 is Vc1=ELVDD-Vref, and a voltage across C2 is Vc2=Vdata-Vref.

In a second operation phase, Vemb(n) and Vs(n+2) in this phase are at a high level, and T1 and T2 are turned off. It can be seen from FIG. 5 that this phase is divided into two time periods. In the first half of the phase, Vs(n) is at a low level, and Vs(n+1) is at a high level. Therefore, T4 and T5 are turned on, T3 is turned off, a potential of the gate of the driving transistor DTFT is still Vdata, the reference signal voltage Vref is connected to point p through T4, a storage capacitor C1 starts to be discharged through the DTFT since T1 is turned off, and a potential at point q starts to decrease from $V_{ELVDD}$. In the second half of the phase, Vs(n) is at a high level, and Vs(n+1) is at a low level. Therefore, T4 and T5 are turned off and T3 is turned on. Although T4 is turned off, T3 is turned on. Therefore, the reference signal voltage Vref is still connected to point p through T3. Due to the existence of the reference signal voltage, an end of the storage capacitor C2 which is connected to the gate of the driving transistor has an unchanged potential, i.e., Vdata, the potential at point q will continue to decrease until Vdata+|Vthd|, wherein Vthd is the threshold voltage of the driving transistor DTFT, and at this time, the driving transistor DTFT is turned off. At this time, a voltage across C1 is Vc1=Vdata+|Vthd|−Vref and a voltage across C2 is Vc2=Vdata−Vref.

In a third operation phase, Vs(n+2) in this phase is at a low level, Vs(n), Vs(n+1) and Vemb(n) are at a high level. Therefore, T2 is turned on, and T1, T3, T4 and T5 are turned off. As T2 is turned on, both ends of C2 are connected, C2 is discharged, and a voltage difference between the both ends of C2 becomes 0. Thus, Vc2=0 and a voltage across C1 maintains unchanged.

In a fourth operation phase, Vemb(n) in this phase jumps to a low level, and Vs(n), Vs(n+1) and Vs(n+2) are at a high level. Therefore, T1 is turned on, and T2, T3, T4 and T5 are turned off. At this time, as the voltage across C1 is Vdata+|Vthd|−Vref and the voltage across C2 is 0, a voltage difference between the source and the gate of the driving transistor DTFT is the voltage difference between both ends of C1, i.e., Vsg=Vc1=Vdata+|Vthd|-Vref. Driving current which is provided by the driving transistor and flows through the light-emitting element OLED is as follows:

$$\begin{aligned} I_{oled} &= K(Vgs - |Vthd|)\text{^}2 = K(Vc1 - |Vthd|)\text{^}2 \\ &= K(Vdata + |Vthd| - Vref - |Vthd|)\text{^}2 \\ &= K(Vdata - Vref)\text{^}2. \end{aligned}$$

It can be known from the above equation that current for driving the OLED to emit light is merely related to the reference voltage Vref and the data voltage Vdata, and is unrelated to the threshold voltage Vthd of the DTFT, wherein K is a constant related to a process and a design.

It should be further noted that an offset of a rising edge of Vemb(n) relative to a rising edge of Vs(n) in the first operation phase may be adjusted, i.e., a time length of the first operation phase may be adjusted. This also adjusts a time length of the second operation phase at the same time, i.e., a time length required for compensating for the threshold voltage of the driving transistor DTFT. Of course, turn-off time of the light-emitting control signal may be aligned with turn-off time of the first level of scanning signals. In this case, the time for compensating for the threshold voltage of the driving transistor is a turn-on period of the second level of scanning signals. For a high-resolution display panel, as data voltage write time for each row (i.e., the first operation phase) is shortened but the time for compensating for the threshold voltage of the driving transistor (the second operation phase) is not shortened, the circuit which can adjust the time for compensating for the threshold voltage is especially essential to the high-resolution display panel. Otherwise, a condition that a circuit operation for a next row is started when the threshold voltage of the driving transistor has not been completely compensated may occur. In this case, the uniformity of the display of the high-resolution panel cannot be improved. With the pixel driving circuit according to the present disclosure, not only the data voltage write time is shortened, but also it ensures that there is enough time to compensate for the threshold voltage of the driving unit. Therefore, the present disclosure supports a high-resolution panel.

Although the specific structures of the driving unit, the first switch unit, the second switch unit, the third switch unit, the first storage unit, the second storage unit and the charging control unit according to the present disclosure are illustrated in FIG. 4, it can be understood by those skilled in the art that these units may use other structures. FIG. 4 merely illustrates an example thereof.

Figure 10:
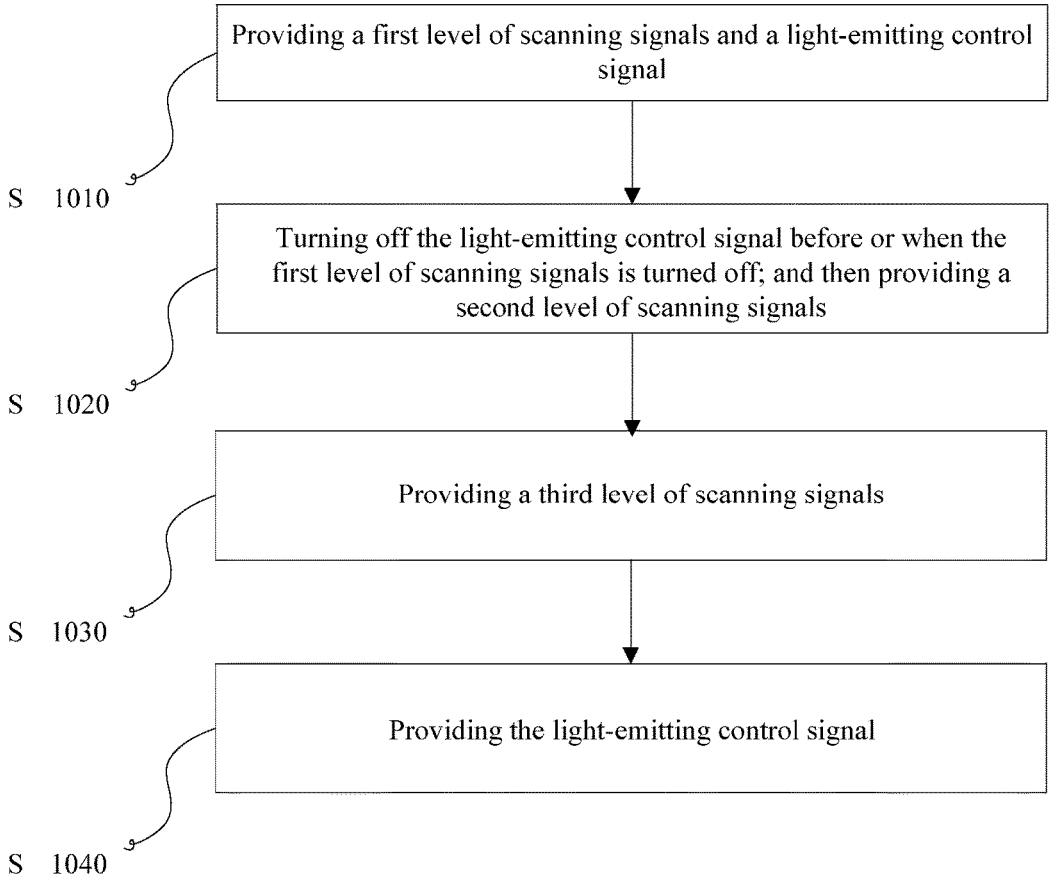
FIG. 10 is a flowchart of a pixel driving method according to an embodiment of the present disclosure.

FIG. 10 illustrates a flowchart of a pixel driving method according to an embodiment of the present disclosure. The method is applied to the pixel driving circuit according to the embodiment of the present disclosure. As shown, the driving method comprises the following steps. Firstly, in S1010, a first level of scanning signals is provided through the first level of scanning signal lines, while providing a light-emitting control signal through the light-emitting control signal line, so that the pixel driving circuit enters a first operation phase. Then, in S1020, the light-emitting control signal is turned off before or when the first level of scanning signals is turned off, so that the pixel driving circuit enters a second operation phase, and then a second level of scanning signals is provided through the second level of scanning signal lines. In S1030, a third level of scanning signals is provided through the third level of scanning signal lines, so that the pixel driving circuit enters a third operation phase. Next, in S1040, the light-emitting control signal is provided through the light-emitting control signal line when the third level of scanning signals is turned off, so that the pixel driving circuit enters a driving phase.

As shown in FIG. 5, the first level of scanning signal lines provides a first level of scanning signals, the light-emitting control signal line provide a light-emitting control signal, and at this time, the pixel driving circuit enters a first operation phase. Then, the light-emitting control signal is turned off, and the pixel driving circuit enters a first half of a second operation phase. Then, when the second level of scanning signal lines provides a second level of scanning signals, i.e., the first level of scanning signals is turned off, the pixel driving circuit enters a second half of the second operation phase. Then, when the third level of scanning signal lines provides a third level of scanning signals, the pixel driving circuit enters a third operation phase. Finally, when the light-emitting control signal line provides a light-emitting control signal, the pixel driving circuit enters a driving phase to drive the light-emitting element to emit light. As the storage capacitor C1 compensates for the threshold voltage of the driving unit, driving current provided by the driving unit to the light-emitting element is unrelated to the threshold voltage of the driving unit. An offset of turn-off time of the light-emitting control signal relative to turn-off time of the first level of scanning signals may be adjusted, to ensure a time length of the second operation phase (i.e., the threshold voltage compensation phase), so that there is enough time for the storage capacitor C1 to acquire a data voltage and a threshold voltage of the driving unit through self-discharge.

More specifically, in combination with the pixel driving circuit illustrated in FIG. 4, when the operation timing illustrated in FIG. 5 is applied, in the first operation phase of the pixel driving circuit, the first transistor, the fourth transistor, and the fifth transistor are turned on, and the second transistor and the third transistor are turned off. In the second operation phase of the pixel driving circuit, the third transistor is turned on, the first transistor and the second transistor are turned off, and the fourth transistor and the fifth transistor are turned on in a first half of the second operation phase and are turned off in a second half of the second operation phase. In the third operation phase of the pixel driving circuit, the second transistor is turned on, and the first transistor, the third transistor, the fourth transistor, and the fifth transistor are turned off. In the driving phase of the pixel driving circuit, the first transistor is turned on, and the second transistor, the third transistor, the fourth transistor, and the fifth transistor are turned off.

The present disclosure further discloses a display apparatus comprising the pixel driving circuit described above. The pixel circuit has been described in detail in the above embodiments, and will not be described here in detail.

In the pixel driving circuit, pixel driving method and display apparatus according to the present disclosure, the gate potential of the driving unit is stabilized using an auxiliary storage unit in a case that the data voltage write switch is turned off, so that there is enough time for the storage unit to acquire the data voltage and the threshold voltage of the driving unit through self-discharge, and the storage unit compensates for the driving unit in the driving phase. In this way, the operating current of the driving unit is not influenced by the threshold voltage.

It should be noted that the technical solutions of the present disclosure are merely described by way of example in the above description, and it does not mean that the present disclosure is limited to the above steps and structures. The steps and structures may be adjusted and selected as needed if possible. Therefore, some steps and units are not elements necessary for implementing the general inventive idea of the present disclosure. Consequently, the technical features necessary for the present disclosure are merely limited by the minimum requirements for implementing the general inventive idea of the present disclosure instead of the above specific examples.

The present disclosure has been described herein in conjunction with preferable embodiments. It should be understood that various other changes, substitutions and additions can be made by those skilled in the art without departing from the spirit and scope of the present disclosure. Therefore, the scope of the present disclosure is not limited to the above particular embodiments, and should be defined by the appended claims.

We claim:

1. A pixel driving circuit for driving a light-emitting element, comprising:

a light-emitting control signal line configured to provide a light-emitting control signal;

a driving unit having an input end connected to a first intermediate node, a control end connected to a third intermediate node, and an output end connected to one end of the light-emitting element, wherein the light-emitting element has the other end connected to a first power line;

a first switch unit having an input end connected to a second power line, a control end connected to the light-emitting control signal line, and an output end connected to the first intermediate node;

a second switch unit having an input end connected to a reference signal line, a control end connected to a second level of scanning signal lines, and an output end connected to a second intermediate node;

a first storage unit having a first end connected to the first intermediate node and a second end connected to the second intermediate node;

a second storage unit having a first end connected to the second intermediate node and a second end connected to the third intermediate node;

a third switch unit having an input end connected to the third intermediate node, a control end connected to a third level of scanning signal lines, and an output end connected to the second intermediate node;

a charging control unit having a first input end connected to the reference signal line, a second input end connected to a data line, a control end connected to the first level of scanning signal lines, a first output end connected to the second intermediate node, and a second output end connected to the third intermediate node;

wherein, in a first operation phase of the pixel driving circuit, the second power line and the first intermediate node are conducted by the first switch unit under the control of the light-emitting control signal output by the light-emitting control signal line, the reference signal line and the second intermediate node are conducted by the charging control unit under the control of a first level of scanning signals output by the first level of scanning signal lines, to charge the first storage unit connected to the first intermediate node and the second intermediate node, and the data line and the third intermediate node are conducted by the charging control unit to charge the second storage unit connected to the third intermediate node and the second intermediate node;

in a second operation phase of the pixel driving circuit, the reference signal line and the second intermediate node are conducted by the second switch unit under the control of a second level of scanning signals output by the second level of scanning signal lines, to maintain a voltage across the second storage unit so as to stable a voltage at the control end of the driving unit, while the first switch unit is turned off by the light-emitting control signal, and the first storage unit is self-discharged through the driving unit, to store a data voltage and a threshold voltage of the driving unit in a self-discharge manner;

in a third operation phase of the pixel driving circuit, the third intermediate node and the second intermediate node are conducted by the third switch unit under the control of the third level of scanning signals output by the third level of scanning signal lines, to discharge the second storage unit;

in a driving phase of the pixel driving circuit, the second power line and the first intermediate node are conducted by the first switch unit under the control of the light-emitting control signal output by the light-emitting control signal line, so that a voltage difference between the control end and the input end of the driving unit is equal to a voltage of the first storage unit, to compensate for the threshold voltage of the driving unit, so as to make driving current provided by the driving unit to the light-emitting element be unrelated to the threshold voltage of the driving unit.

2. The pixel driving circuit according to claim 1, wherein the driving unit comprises a driving transistor, having a gate connected to the third intermediate node, a first electrode connected to said one end of the light-emitting element, and a second electrode connected to the first intermediate node, wherein the first electrode is one of a source and a drain, and the second electrode is the other of the source and the drain.

3. The pixel driving circuit according to claim 1, wherein the first switch unit comprises a first transistor, having a first electrode connected to the second power line, a gate connected to the light-emitting control signal line, and a second electrode connected to the first intermediate node, wherein the first electrode is one of a source and a drain, and the second electrode is the other of the source and the drain.

4. The pixel driving circuit according to claim 1, wherein the second switch unit comprises a third transistor, having a first electrode connected to the reference signal line, a gate connected to the second level of scanning signal lines, and a second electrode connected to the second intermediate node, wherein the first electrode is one of a source and a drain, and the second electrode is the other of the source and the drain.

5. The pixel driving circuit according to claim 1, wherein the first storage unit comprises a first storage capacitor connected between the first intermediate node and the second intermediate node.

6. The pixel driving circuit according to claim 1, wherein the second storage unit comprises a second storage capacitor connected between the second intermediate node and the third intermediate node.

7. The pixel driving circuit according to claim 1, wherein the third switch unit comprises a second transistor, having a first electrode connected to the third intermediate node, a gate connected to the third level of scanning signal lines, and a second electrode connected to the second intermediate node, wherein the first electrode is one of a source and a drain, and the second electrode is the other of the source and the drain.

8. The pixel driving circuit according to claim 1, wherein the charging control unit comprises a fourth transistor and a fifth transistor, in which each of the fourth transistor and the fifth transistor has a gate connected to the first level of scanning signal lines, the fourth transistor has a first electrode connected to the reference signal line and a second electrode connected to the second intermediate node, and the fifth transistor has a first electrode connected to the data line and a second electrode connected to the third intermediate node, wherein the first electrode is one of a source and a drain, and the second electrode is the other of the source and the drain.

9. The pixel driving circuit according to claim 2, wherein the driving transistor is a P-type thin film transistor.

10. The pixel driving circuit according to claim 3, wherein the first transistor is a P-type thin film transistor.

11. The pixel driving circuit according to claim 4, wherein the third transistor is a P-type thin film transistor.

12. The pixel driving circuit according to claim 7, wherein the second transistor is a P-type thin film transistor.

13. The pixel driving circuit according to claim 8, wherein the fourth transistor and the fifth transistor are P-type thin film transistors.

14. A pixel driving method applied in the pixel driving circuit according to claim 1, comprising: providing a first level of scanning signals through the first level of scanning signal lines, while providing a light-emitting control signal through the light-emitting control signal line and a data signal on the data line, so that the pixel driving circuit enters the first operation phase;

turning off the light-emitting control signal before or when the first level of scanning signals is turned off, so that the pixel driving circuit enters the second operation phase; providing a second level of scanning signals through the second level of scanning signal lines;

providing a third level of scanning signals through the third level of scanning signal lines, so that the pixel driving circuit enters the third operation phase; and providing the light-emitting control signal through the light-emitting control signal line when the third level of scanning signals is turned off, so that the pixel driving circuit enters a driving phase.

15. The pixel driving method according to claim 14, wherein an offset of turn-off time of the light-emitting control signal relative to turn-off time of the first level of scanning signals can be adjusted to shorten duration of the first operation phase.

16. The pixel driving method according to claim 14, wherein in the first operation phase of the pixel driving circuit, the first switch unit and the charging control unit are turned on, and the second switch unit and the third switch unit are turned off.

17. The pixel driving method according to claim 14, wherein in the second operation phase of the pixel driving circuit, the second switch unit is turned on, the first switch unit and the third switch unit are turned off, and the charging control unit is turned off when the first level of scanning signals is turned off.

18. The pixel driving method according to claim 14, wherein in the third operation phase of the pixel driving circuit, the third switch unit, the first switch unit, the second switch unit and the charging control unit are turned off.

19. The pixel driving method according to claim 14, wherein in the driving phase of the pixel driving circuit, the first switch unit is turned on, and the second switch unit, the third switch unit and the charging control unit are turned off.

20. A display apparatus, comprising the pixel driving circuit according to claim 1.

* * * * *